US010815102B2

(12) United States Patent
Dodd

(10) Patent No.: US 10,815,102 B2
(45) Date of Patent: Oct. 27, 2020

(54) MOISTURE PROOF SLEEVE BLOCK

(71) Applicant: Tyler Truss Systems, Inc., Pendleton, IN (US)

(72) Inventor: Mark C. Dodd, Pendleton, IN (US)

(73) Assignee: Mark C. Dodd, Pendleton, IN (US)

( * ) Notice: Subject to any disclaimer, the term of this patent is extended or adjusted under 35 U.S.C. 154(b) by 61 days.

(21) Appl. No.: 16/151,617

(22) Filed: Oct. 4, 2018

(65) Prior Publication Data

US 2019/0106308 A1 Apr. 11, 2019

Related U.S. Application Data

(60) Provisional application No. 62/568,543, filed on Oct. 5, 2017.

(51) Int. Cl.

| | |
|---|---|
| ***B66D 3/26*** | (2006.01) |
| ***B66C 1/34*** | (2006.01) |
| ***B66D 1/54*** | (2006.01) |
| ***B66C 1/66*** | (2006.01) |
| ***B66D 1/60*** | (2006.01) |

(52) U.S. Cl.

CPC ..... *B66D 3/26* (2013.01); *B66C 1/34* (2013.01); *B66C 1/66* (2013.01); *B66D 1/54* (2013.01); *B66D 1/60* (2013.01); *B66D 2700/025* (2013.01)

(58) Field of Classification Search

CPC ... B66D 1/34; B66D 1/54; B66D 1/60; B66D 1/66; B66D 2700/025; B66D 3/26

See application file for complete search history.

(56) References Cited

U.S. PATENT DOCUMENTS 1,468,916 A * 9/1923 Newhall ..... B66D 3/18 254/343
1,560,722 A * 11/1925 Peterson ..... B66D 1/00 254/328
2,924,430 A * 2/1960 Smith ..... B66D 3/24 254/344
4,199,133 A * 4/1980 Gagnon ..... A63J 1/028 160/334

(Continued)

OTHER PUBLICATIONS

Tyler Truss Systems; [online]; [Retrieved on Jan. 4, 2019]; Retrieved from http://plsn.com/archives/november-2017/tyler-truss-systems/.

*Primary Examiner* — Michael E Gallion

(74) *Attorney, Agent, or Firm* — Woodward, Emhardt, Henry, Reeves & Wagner, LLP

(57) ABSTRACT

A sleeve block includes a frame that is connectable to an object, such as a truss, that is to be moved relative to a stationary support. An axle defining a longitudinal axis and a motor are to the frame. The sleeve block includes a line that has a first end connected to the motor. The line extends downward from the motor around at least a portion of the axle and then extends outwardly of the frame so that at least a portion of the line is operatively connected to the stationary support. The portion of the line between the axle and the stationary support creates a line axis, and the motor is spaced apart from the line axis. Activation of the rotatable output of said motor causes the frame and the object to move relative to the stationary support by retracting or extending the line from the motor.

20 Claims, 3 Drawing Sheets

(56) References Cited

U.S. PATENT DOCUMENTS 4,568,036 A * 2/1986 Kearney ..... B66D 1/005 242/392
4,635,903 A * 1/1987 Broyden ..... B66D 3/26 174/DIG. 12
4,806,047 A * 2/1989 Morrison ..... E01C 19/40 404/118
5,310,152 A * 5/1994 O'Neill ..... A47B 81/06 248/324
5,562,394 A * 10/1996 Brown, Jr. ..... B66C 1/66 414/626
5,762,282 A * 6/1998 Wolner ..... A62B 1/10 182/73
6,009,927 A * 1/2000 Peters ..... A47G 27/0487 156/574
6,090,264 A * 7/2000 Piron ..... B66C 13/10 204/245
6,179,270 B1 * 1/2001 Higdon ..... B66D 3/16 254/358
6,241,215 B1 * 6/2001 Gersemsky ..... A61G 7/1042 254/342
6,994,510 B2 * 2/2006 Cooke ..... B62D 65/18 414/618
8,099,913 B1 * 1/2012 Dodd ..... A63J 1/02 182/150
8,616,529 B2 * 12/2013 Kim ..... B66D 1/50 254/335
8,657,261 B2 * 2/2014 Mehrkens ..... A63C 11/10 254/323
8,708,314 B2 * 4/2014 Scott ..... B66D 1/12 254/266
9,134,600 B2 * 9/2015 Dodd ..... G03B 21/58
9,284,170 B2 * 3/2016 Guimaraes ..... B66D 3/02
9,700,810 B2 * 7/2017 Hoffend, Jr. ..... B66D 1/26
9,758,340 B1 * 9/2017 Reese ..... B65H 54/02
9,790,065 B2 * 10/2017 Jordan ..... B66D 3/04
9,802,800 B2 * 10/2017 Kalakay, Jr. ..... B66D 3/26
10,053,340 B2 * 8/2018 Albinger ..... B66C 23/821
D874,782 S * 2/2020 Detering ..... D34/33
10,569,997 B1 * 2/2020 Fusillo ..... A01K 87/04
2008/0185564 A1 * 8/2008 LaFreniere ..... B66D 3/18 254/342
2011/0193037 A1 * 8/2011 Smith ..... B66D 3/18 254/336
2013/0161477 A1 * 6/2013 Kempf ..... F16M 13/02 248/674
2013/0181177 A1 * 7/2013 Moll ..... B66D 1/36 254/338
2015/0090946 A1 * 4/2015 Schwaiger ..... B66D 3/26 254/362

* cited by examiner

MOISTURE PROOF SLEEVE BLOCK

CROSS REFERENCE TO RELATED APPLICATIONS

The present patent document claims the benefit of the filing date of Provisional U.S. Patent Application No. 62/568,543, filed on Oct. 5, 2017, which is hereby incorporated by reference in its entirety.

BACKGROUND OF THE INVENTION

The present invention relates generally to the field of hoists used to raise and lower various objects. In the case of lifting and lowering trusses, the hoists are generally attached to the truss in a motor or body down configuration with the chain or line extending vertically to the attachment point. The motor extends or retracts the chain or line allowing the truss to be raised and lowered. The chain or line extends vertically with the result that moisture travels downwardly on the chain and enters the motor thereby shortening the life of the motor or at least requiring maintenance. Since trusses are constructed out of doors, moisture entering the lifting motor is a continual problem. Disclosed herein is a lifting device that solves the aforementioned problem.

DESCRIPTION OF THE PREFERRED EMBODIMENT

Figure 1:
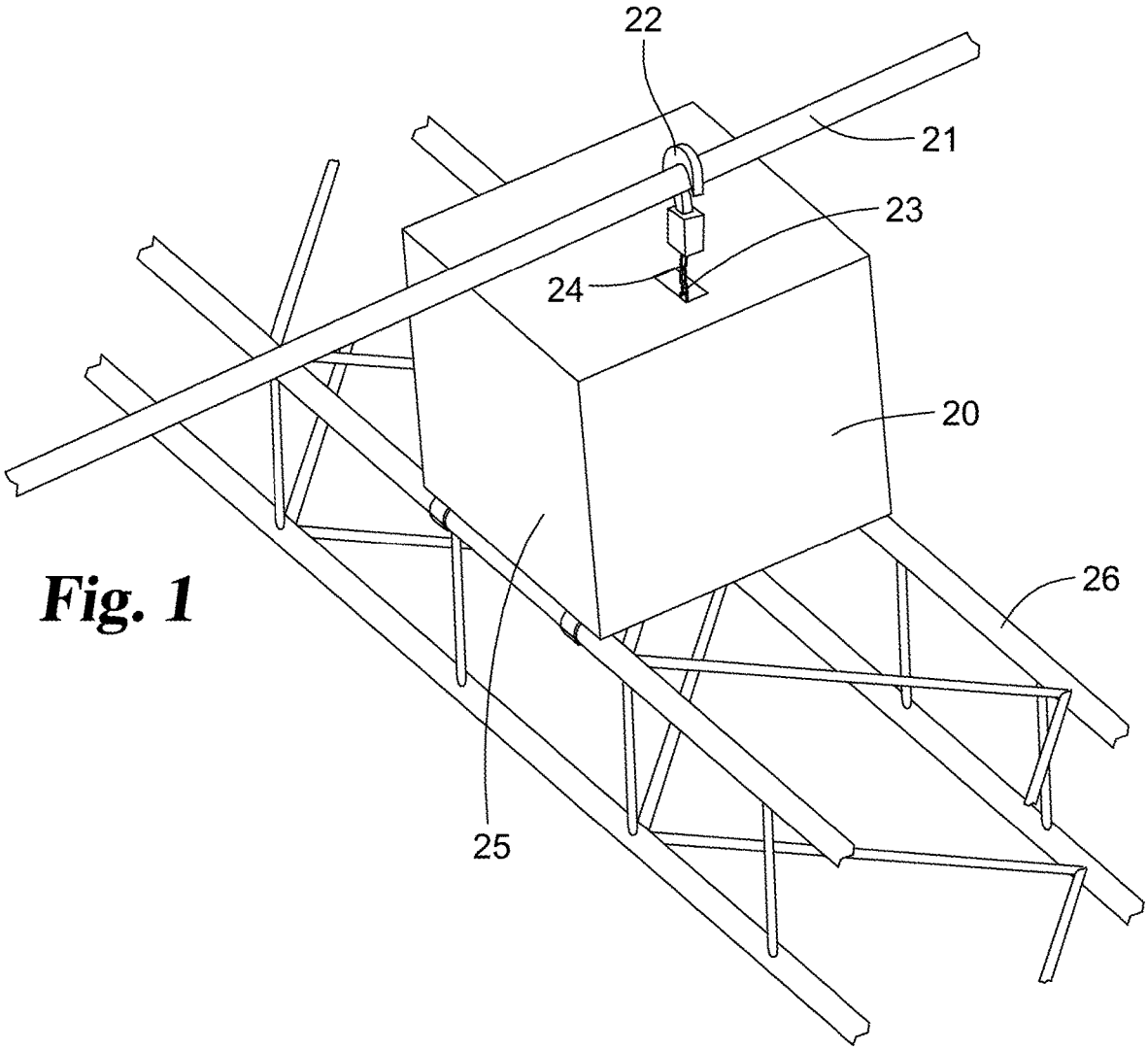
FIG. 1 is perspective view of the moisture proof sleeve block, incorporating the preferred embodiment of the present invention, is removably attached to a truss shown in fragment.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The moisture sleeve block 20 is removably attached to truss 26 for lifting and lowering the truss. A chain 24 or other suitable line extends outwardly through hole or slot 23 provided in the top wall of the outer casing 25. A hook 22 is mounted to one end of chain 24 and is removably attachable to a stationary element 21, such as a rod. The sleeve block includes a motor therein for extending and withdrawing chain 24. As the chain is extended, the moisture proof sleeve block lowers along with the item attached thereto, such as truss 26 whereas retraction of chain 24 causes the sleeve block along with the truss to rise.

Figure 2:
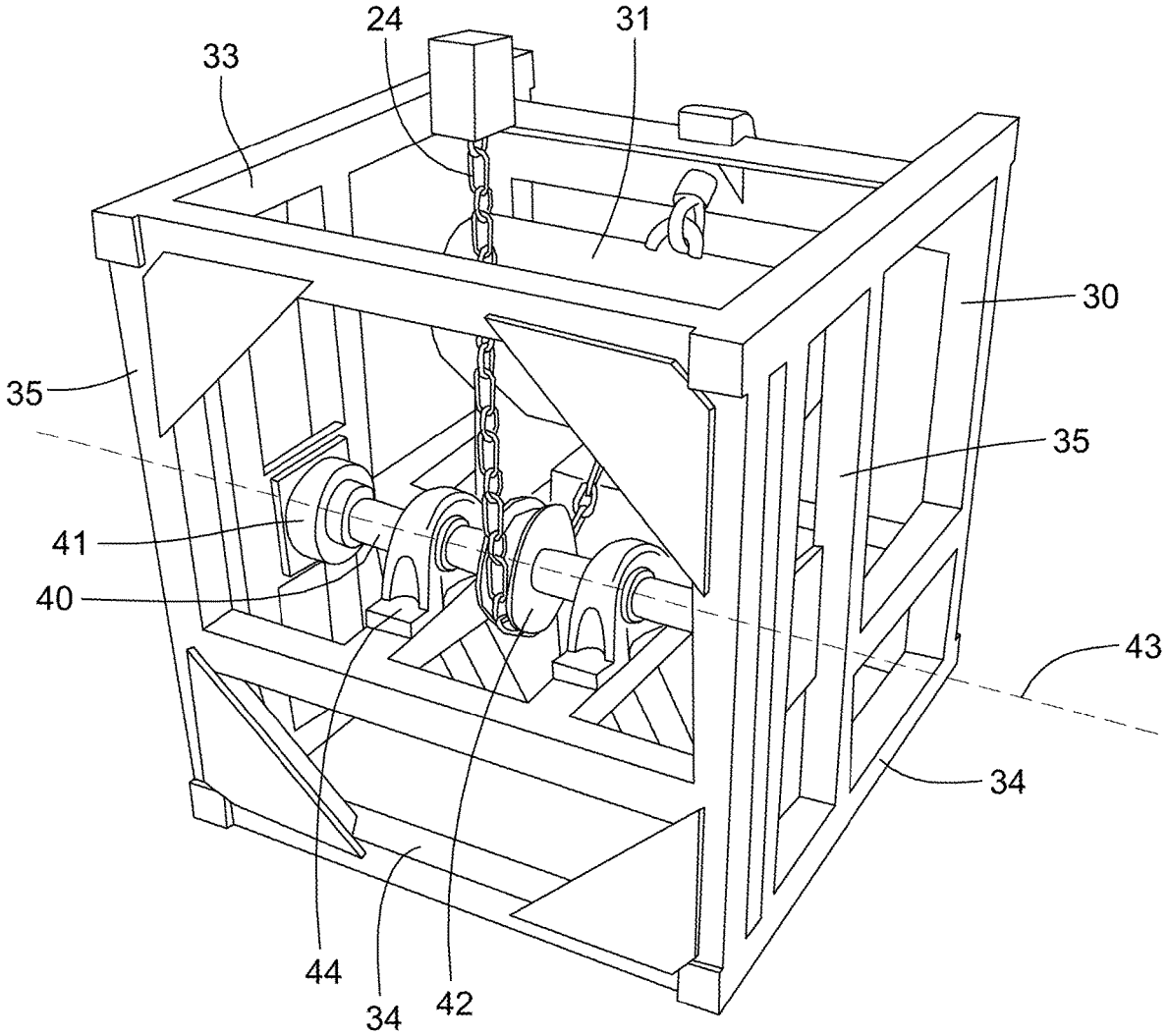
FIG. 2 is an enlarged perspective view of the sleeve block with the outer encasing removed therefrom.
Figure 3:
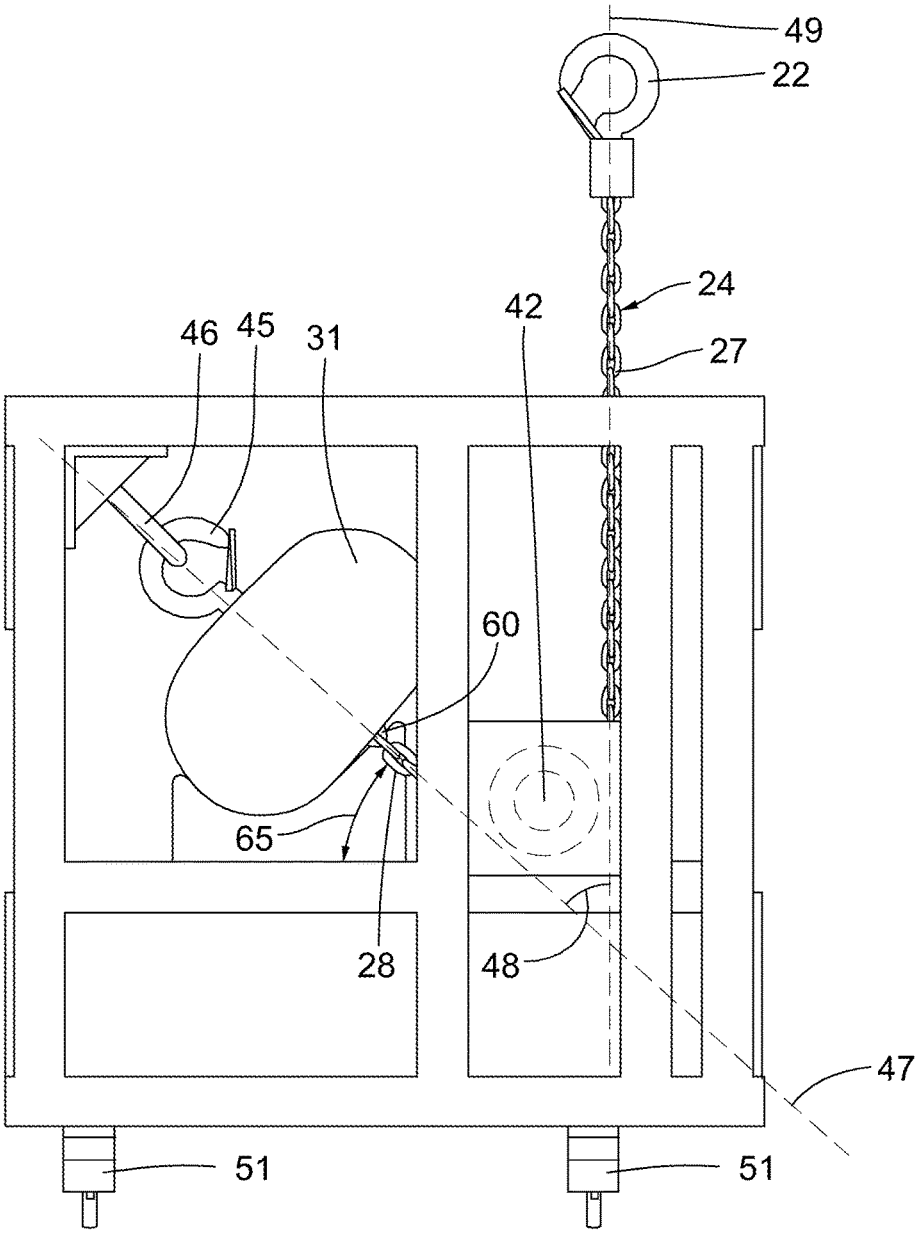
FIG. 3 is a side view of the sleeve block of FIG. 2 showing the orientation of the lift motor with chain extending around a grooved rotatable wheel.
Figure 4:
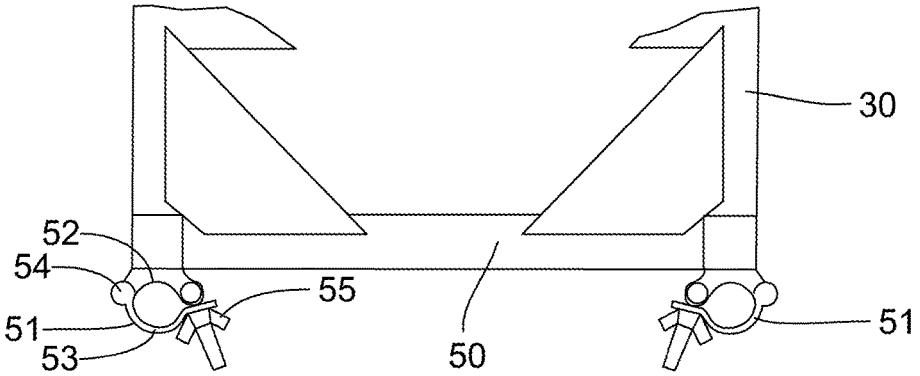
FIG. 4 is a fragmentary side view of the lift block illustrating the clamps for removably securing the truss thereto.

Casing 25 is a five sided box with an open bottom and slides over and around frame 30 thereby shielding the frame and contents from external moisture. Casing 25 has been removed from FIGS. 2-4 to illustration the construction of frame 30 and its components, namely motor 31, wheel 42 and chain 24. Frame 30 is rigidly constructed including a plurality of upper cross members 33 and lower cross members 34 secured together by a plurality of vertical cross members 35. Upper cross members 33 are positioned at a location closer to stationary object 21 than lower cross members 34. A rotatable axle 40 has its opposite ends rotatably mounted to bearings 41, in turn, attached to the vertical cross members 35. In addition, a pair of supporting bearings 44 are mounted inward of the opposite ends of axle 40 with wheel 42 mounted to axle 40 and rotatable therewith along a horizontal axis 43 that is defined through axle 40. Wheel 42 is attached to axle 40 so that relative motion between the wheel and axle does not occur.

A commercially available motor 31 (FIG. 3) is mounted by a hook 45 attached thereto and extending around an eye bolt or other suitable fastener 46, in turn, secured to frame 30. In the embodiment shown, fastener 46 is attached to frame 30 at an upper cross member 33. A chain, line or other member 24 extends out of motor 31 around wheel 42 and then upwardly to a mounting hook 22 that is attached to stationary object 21. Motor 31 has a rotatable output with chain 24 wrapped thereon. The motor is operable to allow the chain to be extended from the motor and also operable to retract the chain relative to the motor.

The bottom portion 50 of frame 30 is removably attached to the truss 26 or any other object to be raised and lowered. In the embodiment shown in FIG. 4, the bottom portion 50 of frame 30 includes a clamp 51 located at each corner of the bottom of the frame. For example, in the side view of the frame shown in FIG. 3, clamps 51 are spaced apart and are located adjacent two of the corners. Likewise, in the end view of the frame shown in FIG. 4, clamps 51 are also shown located adjacent each bottom corner of the frame. Thus, a total of four clamps may be utilized to removably secure the truss to frame 30. A greater number or lesser number than 4 clamps may be utilized with the sleeve block.

In the embodiment shown in the drawings, clamp 51 includes a downwardly facing concave portion 52 secured to frame bottom portion 50 with an upwardly facing concave portion 53 pivotally mounted to portion 52 about hinge 54. The truss member may be positioned between mutually facing concave portions 52 and 53 with the concave portions then being secured together by a bolt wingnut combination 55.

Motor 31 is arranged inside a frame or block 30 offset to the side of and spaced apart from axle 40 and wheel 42 with chain 24 extending from outlet 60 of the motor downward to limit flow of moisture on the line into the motor. The line extends downward from the motor, in the direction of lower cross members 34 along a motor output axis 47, to wheel 42 at an approximate 45 degree angle 65 relative to a vertical axis (FIG. 3) intersecting the horizontally extending longitudinal axis of rotation 43 of axle 40 and wheel 42. The chain or line 24 extends partially around wheel 42 which may be grooved to limit or prevent slippage between the chain and the wheel, and in turn, also extends at least partially around axle 40.

Chain 24 extends vertically upward from wheel 42, toward upper cross members 33, to hook 22 secured to the stationary object 21. The support portion 27 of chain 24 that extends from axle 40 to stationary object 21 forms a line axis 49 that is defined through chain 24 (see FIG. 3). Motor 31 is spaced apart from line axis 49, so that line axis 49 does not intersect with motor 31. Thus, since motor 31 is not positioned on line axis 49, any moisture running vertically down towards axle 40 or the wheel 42 from hook 22 may drip downwardly away from motor 31. Likewise, since chain 24 extends downwardly from the motor towards wheel 42, any moisture existing on the chain will flow downward away from the motor.

A motor output portion 28 of the line or chain 24 that extends along the motor output axis 47 from motor 31 to axle 40 and the support portion 27 of chain 24 that extends along the line axis 49 from axle 40 to stationary object 21 work together to assist in preventing moisture from entering motor 31. Motor output axis 47 is arranged at an acute angle 48 (see FIG. 3) with respect to line axis 49, so that chain 24 changes direction as chain 24 extends at least partially around axle 40. This change in direction prevents moisture on the support portion 27 of chain 24 from dripping into motor 31. The acute angle 48 between motor output axis 47 and line axis 49 also causes the chain 24 to extend downward from motor 31, in the direction of the lower cross members 34; therefore, gravity will encourage moisture on the motor output portion 28 of the chain 24 to drip away from motor 31.

In order to lift an object, such as a truss, utilizing the moisture proof sleeve block, the truss or other object to be lifted or lowered is attached by clamps 51 to the bottom portion 50 of frame 30. Hook 22 is attached to the stationary object 21. In order to lift the truss, motor 31 is activated to retract chain 24 into the motor housing causing the frame 30 along with motor 31 and axle 40 and the attached truss to raise vertically upward towards hook 22 and the stationary object 21. Likewise, to lower the truss, motor 31 is activated to cause the chain to extend further outward from the motor causing the frame, motor, wheel 42 and truss to be lowered. The distance between wheel 42 and motor 31 remains constant since both are attached to frame 30 with the variable being the length of chain 24 extending from hook 22 to wheel 42.

What is claimed is:

1. A sleeve block, comprising:

a frame including cross members, wherein said frame is connectable to an object to be moved relative to a stationary support;

an axle mounted between said cross members of said frame, wherein said axle defines a longitudinal axis;

a motor mounted to said frame, said motor having a rotatable output;

a line with a first end connected to said rotatable output of said motor, wherein said line extends around at least a portion of said axle and wherein said line extends outwardly of said frame so at least a portion of said line is operatively connected to said stationary support, wherein a line axis is defined by a portion of the line extending between said axle and said stationary support;

a hook attached to said motor;

a fastener positioned on said frame, wherein said fastener is configured to receive said hook, and wherein said motor is removably mounted to said frame by attachment of said hook to said fastener;

wherein said motor is positioned so that said motor is spaced apart from said line axis; and wherein activation of said rotatable output of said motor is configured to move said frame and said object relative to said stationary support by retracting or extending said line from said motor.

2. The sleeve block of claim 1, wherein said frame includes an upper cross member and a lower cross member, and wherein said upper cross member is closer to said stationary support than said lower cross member.

3. The sleeve block of claim 2, wherein said line extends downward from said rotatable output of said motor, in the direction of said lower cross member.

4. The sleeve block of claim 1, wherein a motor output axis is defined by a portion of the line extending between said rotatable output and said axle, and wherein said motor output axis is positioned at an acute angle with respect to said line axis.

5. The sleeve block of claim 1, further comprising:

a wheel mounted to said axle, wherein said wheel is rotatable.

6. The sleeve block of claim 5, wherein said line extends around said wheel when said line extends around at least a portion of said axle.

7. The sleeve block of claim 1, wherein said line extends vertically upward from said axle to said stationary support.

8. The sleeve block of claim 1, wherein retraction of said line into said motor causes said frame and said object to move closer to said stationary support.

9. The sleeve block of claim 1, wherein extension of said line from said motor causes said frame and said object to move away from said stationary support.

10. The sleeve block of claim 1, wherein said line includes a second end and wherein said second end is connected to said stationary support.

11. The sleeve block of claim 1, further comprising:

a casing extending around said frame, wherein said casing is configured to limit moisture flow onto said frame.

12. The sleeve block of claim 11, wherein said motor is positioned within said casing.

13. The sleeve block of claim 1, wherein said axle is rotatable with respect to said frame.

14. The sleeve block of claim 1, wherein said line extends between said axle and said stationary support in a direction substantially perpendicular to said longitudinal axis defined through said axle.

15. The sleeve block of claim 1, wherein a distance between said motor and said axle remains constant upon activation of rotatable output of said motor.

16. The sleeve block of claim 1, wherein said object is a truss.

17. The sleeve block of claim 1, further comprising:

a first clamp attached to said frame, wherein said first clamp is attachable to said object to be lifted.

18. The sleeve block of claim 17 further comprising:

a second clamp attached to said frame, wherein said second clamp is attachable to said object to be lifted.

19. A sleeve block for lifting and lowering an object relative to a stationary support, comprising:

a frame connectable to a truss to be lifted and lowered relative to a stationary support, wherein said frame includes an upper cross member and a lower cross member, and wherein said upper cross member is closer to said stationary support than said lower cross member;

an axle mounted to said frame, wherein said axle defines a longitudinal axis;

a wheel mounted to said axle and wherein said wheel is rotatable about said longitudinal axis with respect to said frame;

a motor mounted to said frame, wherein said motor is spaced apart from said wheel and said axle, said motor having a rotatable output;

a chain with a first end connected to said rotatable output of said motor, said chain extending downward from said motor, toward said lower cross member, promoting flow of moisture on said chain away from said motor, said chain then extending around said wheel spaced apart from said motor and then vertically upward from said wheel, toward said upper cross member, and outwardly of said frame to be operatively connected to said stationary support;

a plurality of clamps attached to said frame, wherein said clamps are attachable to said truss;

wherein retraction of said chain into said motor causes said frame and said truss to move closer to said stationary support; and wherein extension of said chain from said motor causes said frame and said truss to move away from said stationary support.

20. A sleeve block, comprising:

a frame including cross members, wherein said frame is connectable to an object to be moved relative to a stationary support;

an axle mounted between said cross members of said frame, wherein said axle defines a longitudinal axis;

a motor mounted to said frame, said motor having a rotatable output;

a line with a first end connected to said rotatable output of said motor, wherein said line extends around at least a portion of said axle and wherein said line extends outwardly of said frame so at least a portion of said line is operatively connected to said stationary support, wherein a line axis is defined by a portion of the line extending between said axle and said stationary support;

a wheel mounted to said axle, wherein said wheel is rotatable, and wherein said line extends around said wheel when said line extends around at least a portion of said axle;

wherein said motor is positioned so that said motor is spaced apart from said line axis; and wherein activation of said rotatable output of said motor is configured to move said frame and said object relative to said stationary support by retracting or extending said line from said motor.

* * * * *